US005337656A

United States Patent [19]

Hollnagel

[11] Patent Number: 5,337,656

[45] Date of Patent: Aug. 16, 1994

[54] OIL FILTER CRUSHING APPARATUS HAVING AIR BAG ACTUATOR

[75] Inventor: Harold E. Hollnagel, Milwaukee, Wis.

[73] Assignee: KCS Industries Inc., Milwaukee, Wis.

[21] Appl. No.: 57,580

[22] Filed: May 6, 1993

[51] Int. Cl.[5] ..... B30B 9/32; B30B 9/04

[52] U.S. Cl. ..... 100/98 R; 100/125; 100/266; 100/269 A; 100/902

[58] Field of Search ..... 100/98 R, 125, 131, 100/266, 269 A, 902

[56] References Cited

U.S. PATENT DOCUMENTS

| | | | |
|---|---|---|---|
| 633,665 | 9/1899 | Spaulding | 100/269 A X |
| 877,139 | 1/1908 | Tatarinoff | 100/269 A |
| 2,122,316 | 6/1938 | Ganio | 100/266 X |
| 2,267,662 | 12/1941 | Miller | 100/266 |
| 2,448,314 | 8/1948 | Kavanagh | 100/269 A X |
| 2,638,957 | 5/1953 | Danielson | 100/902 X |
| 2,737,995 | 3/1956 | Jennings | 100/902 X |
| 3,190,215 | 6/1965 | Howard et al. | 100/257 |
| 3,315,594 | 4/1967 | Simshauser | 100/218 X |
| 3,648,600 | 3/1972 | Jaccard | 100/266 X |
| 3,736,863 | 6/1973 | Brucker | 100/269 A X |
| 3,763,773 | 10/1973 | Clay | 100/269 A X |
| 4,088,072 | 5/1978 | Wittmeier | 100/902 X |
| 4,212,242 | 7/1980 | Willis | 100/902 X |
| 4,240,341 | 12/1980 | Whipple et al. | 100/49 |
| 4,475,449 | 10/1984 | Gianelo | 100/266 X |
| 4,506,578 | 3/1985 | Gaines et al. | 100/269 A X |
| 4,696,227 | 9/1987 | Van Buskirk | 100/902 X |
| 4,927,085 | 5/1990 | Oberg | 241/36 |
| 5,048,413 | 9/1991 | Deiters | 100/226 |
| 5,060,564 | 10/1991 | Buford et al. | 100/52 |
| 5,109,763 | 5/1992 | Morris et al. | 100/48 |
| 5,188,022 | 2/1993 | Benson et al. | 100/902 X |

FOREIGN PATENT DOCUMENTS

| | | | |
|---|---|---|---|
| 1-205899 | 8/1989 | Japan | 100/269 A |
| 597568 | 3/1978 | U.S.S.R. | 100/269 A |
| 15589 | of 1887 | United Kingdom | 100/269 A |

*Primary Examiner*—Stephen F. Gerrity

[57] ABSTRACT

An oil filter crushing apparatus has a crushing frame (12, 312) mounting a filter platform (16, 316) on which a used oil filter is supported on end for crushing by a ram device (40, 336) having a single ram rod (52, 338). An air spring actuating device (42, 344) is mounted on the frame (12, 312) and operates on low pressure shop air for selectively forcing the ram device (40, 336) downwardly to crush the filter against the platform (16, 316).

31 Claims, 8 Drawing Sheets

OIL FILTER CRUSHING APPARATUS HAVING AIR BAG ACTUATOR

TECHNICAL FIELD

This invention relates generally to oil filter crushing presses of the type used for crushing spent disposable-type oil filters to extract residual oil from the filters and reduce their size before disposal.

BACKGROUND OF THE INVENTION

Various oil filter crushing apparatus have been proposed for crushing spent disposable-type oil filters before disposal. Examples of such known prior oil filter presses include those disclosed in the U.S. Pat. Nos. 4,927,085 to Oberg, granted May 22, 1990; 5,060,564 to Buford et al, granted Oct. 29, 1991; and 5,109,763 to Morris et al, granted May 5, 1992.

To be of practical value to small automotive service stations and oil change service facilities, an oil filter press must be compact, simply constructed, low cost, and reliable. The known prior art filter presses all utilize fluid power cylinders to actuate a filter crushing platen which are costly, complex, and have sliding contact seals that wear and require periodic maintenance.

SUMMARY OF INVENTION AND ADVANTAGES

An apparatus for crushing used oil filters comprises: a rigid crushing frame having a base for supporting an oil filter on end; a ram device having a rod slideably supported by the frame for longitudinal movement toward and away from the base and a crushing head secured to a lower end of the rod above the base for engaging and crushing the oil filter; and is characterized by self-contained air spring actuating means having a rigid upper end retaining portion secured to the frame, a rigid lower end retaining portion secured to the ram device, and an intermediate elastic flex member extending between and interconnecting the end retaining portions and defining an enclosed expandable chamber therein for selectively receiving a pressurized actuating fluid therein causing the actuating means to expand and react between the frame and ram device and thereby displacing the crushing head from a raised unactuated position forcibly toward the base to a lowered actuated position to crush the filter interposed between the crushing head and the base.

The oil filter crushing apparatus of this invention is simply constructed and utilizes self-contained air spring actuating means rather than a fluid cylinder to simplify the construction, reduce the cost, and minimize maintenance requirements, and hence is more suitable for use by small service stations and oil change service facilities.

BRIEF DESCRIPTION OF THE DRAWINGS

These and other features and advantages of the invention will become more readily understood and appreciated by those skilled in the art when considered in connection with the following detailed description and drawings, wherein.

DETAILED DESCRIPTION OF THE DRAWINGS

Figure 1:
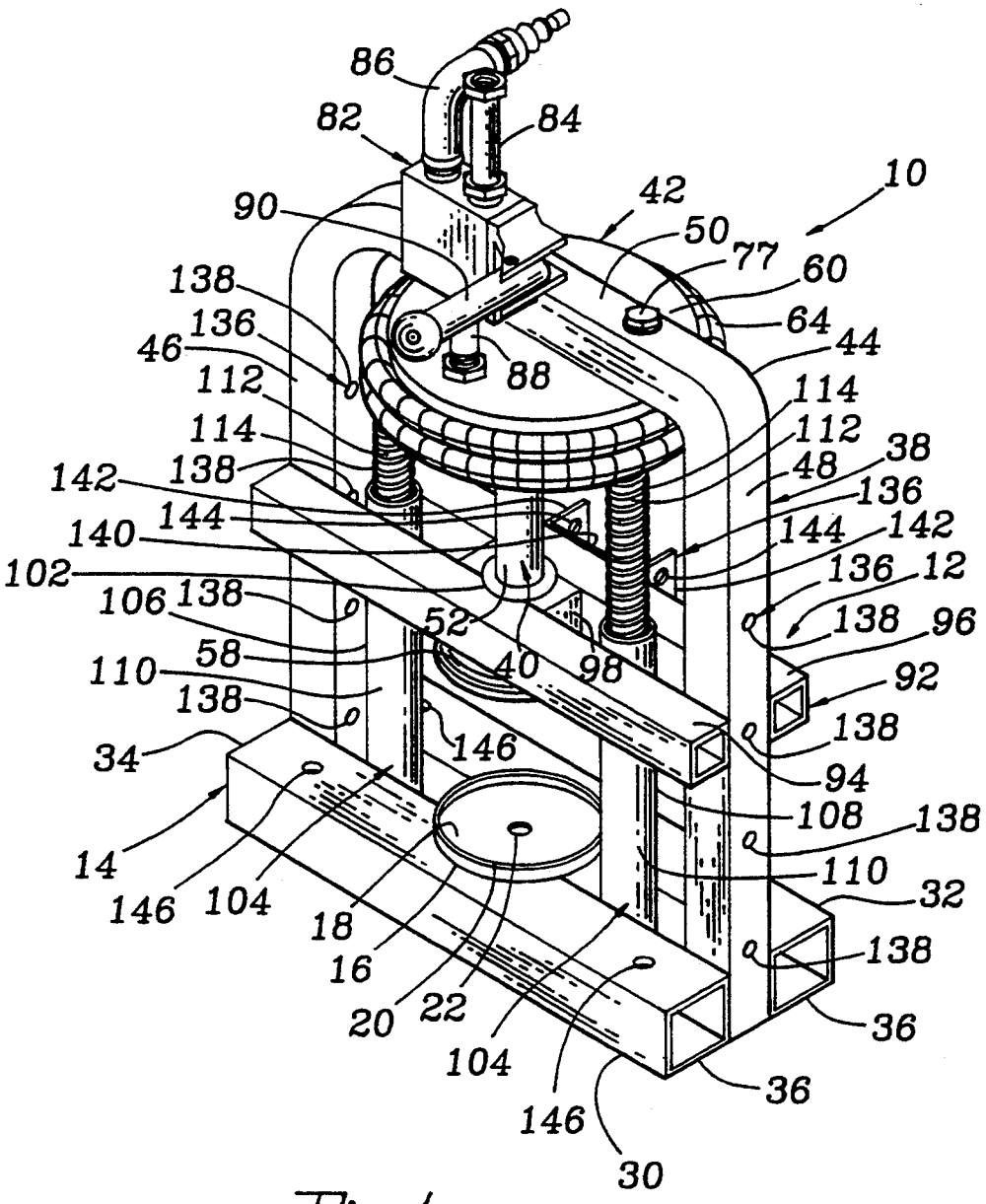
FIG. 1 is a perspective view of a first embodiment of the invention.

An oil filter crushing apparatus constructed according to a first embodiment of the invention is generally indicated at 10 in FIGS. 1-5 and is used to crush spent disposable oil filters of the type normally used in automotive and light truck engine applications in order to reduce the size of the filter and to reclaim residual oil therefrom before disposing of the filter. A representative oil filter is indicated in the drawings by the reference character F.

Figure 2:
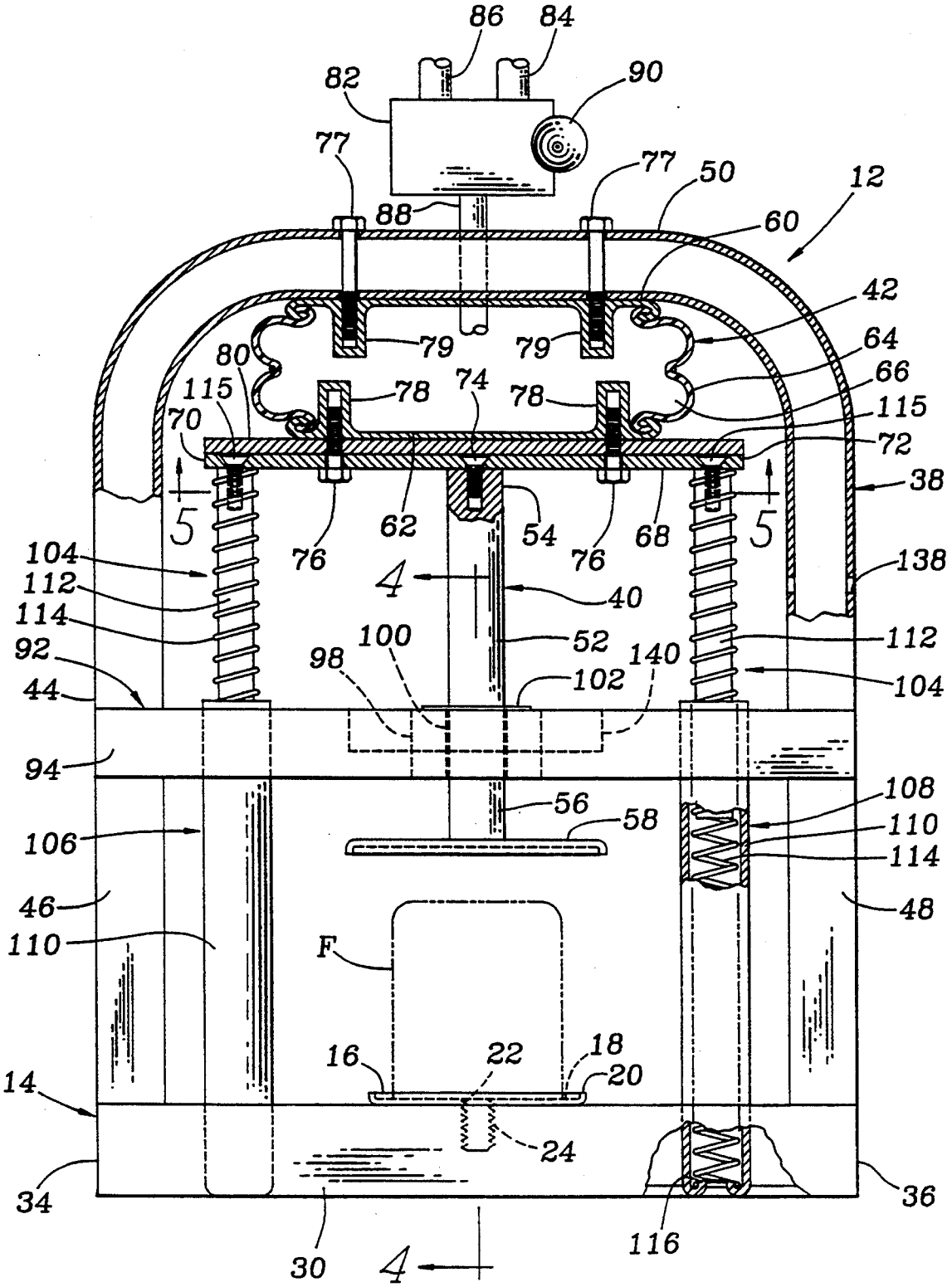
FIG. 2 is an elevation view, shown partly in section, of the press of FIG. 1.

The filter crushing apparatus 10 includes a rigid crushing frame 12 having a base 14 for supporting the filter F on end as shown in FIG. 2. The base 14 preferably includes a circular filter platform 16 having a horizontally disposed flat upper surface 18 on which the filter F rests during crushing. The perimeter of the platform 16 is provided with an upturned lip or ridge 20 to assure proper positioning the filter F on the platform 16 and to prevent the filter F from sliding off the platform 16 during crushing by laterally retaining the filter F.

The platform 16 includes a central drain port or aperture 22, through which the reclaimed oil drains for collection. A reservoir (not shown) may be provided below the platform 16 to collect the residual oil or, the drain port 22 may be provided with a suitable fitting 24 for attachment to a discharge line or hose 28 for transporting the oil to a remote collection reservoir (not shown).

The filter F is positioned on the platform 16, on end with the open end of the filter facing downwardly toward the platform and with the peripheral lip seal of the filter F engaging the upper surface 18 of the platform 16 to seal the filter F against oil leakage except through the drain port 22. Side walls of the filter extend generally vertically upwardly from the platform 16 when supported in the manner described and an upper closed end of the filter is supported above the platform 16 and extends generally horizontally.

Figure 4:
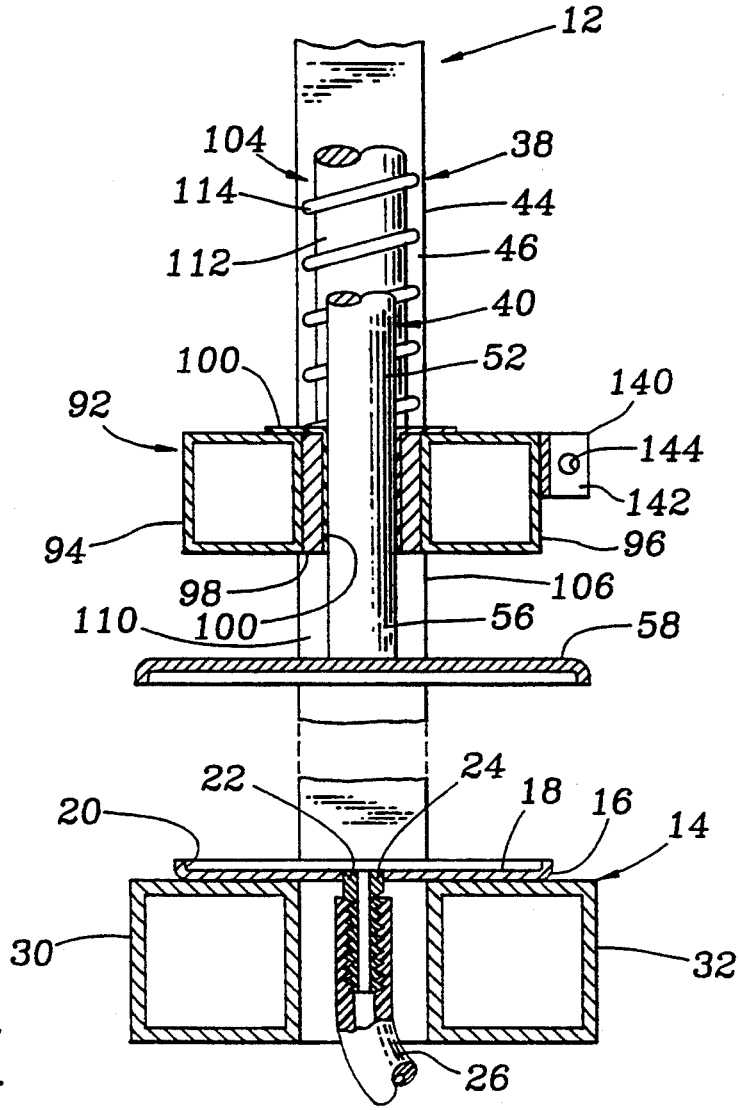
FIG. 4 is a fragmentary sectional view taken along lines 4—4 of FIG. 2.

As best shown in FIGS. 1 and 4, the base 14 includes a pair of horizontally extending parallel and spaced apart front 30 and back 32 mounting members. The mounting members 30, 32 support the platform 16 and in the first embodiment the platform 16 spans a gap between the mounting members 30, 32 and is supported directly by an upper surface of the mounting members 30, 32, as best shown in FIG. 4. The platform 16 may be permanently secured to the mounting members 30, 32 such as by welding or otherwise fixed in position and has drain port 22 located in the gap between the mounting members 30, 32. The mounting members, 30, 32 are preferably constructed of square tubular metal stock and extend between left 34 and right 36 open ends.

The crushing frame 12 includes an upper support frame portion 38 secured to and rigidly supported by the base portion 14. The upper support frame portion 38 supports a ram device 40 and self-contained air spring actuating means 42, as will be explained in further detail below.

The upper support frame portion 38 in the first embodiment includes a single U-shaped tubular member 44 preferably constructed from a single piece of tubular square metal stock which has been bent into the general shape of a U so as to provide a pair of vertically upstanding spaced apart and parallel left 46 and right 48 leg portions and a horizontally disposed top connecting portion 50 that extends between the legs 46, 48 and integrally joins them to one another. The U-shaped tubular member 44 is supported in an inverted fashion with free ends of the leg portions 46, 48 extending into the gap between the mounting members 30, 32 and rigidly secured to the mounting members 30, 32 such as by welding. In this manner, the leg portions 46, 48 extend vertically up from the base portion 14 and support the top connecting portion 50 spaced above the base 14.

The ram device 40 has a single ram rod or shaft 52 preferably constructed of solid round metal bar stock that extends vertically between upper 54 and lower 56 ends thereof approximately midway between the left and right leg portions 46, 48 of the U-shaped tubular member 44. A pressing plate or crushing head 58 is secured to the lower end 56 of the ram rod 52 directly above the filter platform 16 for engaging the top end of the filter F during crushing.

The self-contained air spring actuating means or actuator 42 is disposed between the upper end 54 of the ram rod 52 and the top connecting portion 50 of the U-shaped tubular member 44. The actuator 42 comprises an air spring actuating device having rigid upper end 60 retaining portion or plate 60 and a rigid lower end retaining portion 62 which are secured to the top connecting portion 50 and the upper end 54 of the rod 52, respectively. The retaining portions 60, 62 are preferably fabricated of cast aluminum and have a generally circular disc shape. A flex member or bellows 64 is connected in sealing engagement with each of the upper and lower ends retaining portions 60, 62 thereby joining the portions 60, 62 and defining an enclosed expandable chamber 66 within the actuator 42 into which a pressurized actuating fluid, such as air, may be introduced to expand the chamber 66 and actuate the ram device 40 as will be explained in more detail below. The flex member 64 is a convoluted bellows-type member fabricated preferably of rubber defining a flexible expandable membrane encircling the perimeter of the upper and lower end retaining portions 60, 62 and is joined in sealing engagement with each of the retaining portions 60, 62 to define the enclosed airtight expandable chamber 66 between the retaining portions 60, 62.

A pressing plate 68 is secured to the upper end 54 of the ram rod 52 and extends horizontally between opposite left 70 and right 72 ends that are spaced inwardly of the leg portions 46, 48 of the U-shaped tubular member 44. The pressing plate 68 is fabricated of rectangular metal plate material and is secured to the ram rod 52 preferably by machine screws 74. The lower end retaining portion 62 of the actuator is likewise secured to the pressing plate 68 by bolts or machine screws 76 which extend through corresponding apertures in the pressing plate 68 and are threadably received into blind threaded mounting taps 78 of the lower end retaining portion 62.

The upper retaining portion 60 is similarly secured to the top connecting portion 50 by bolts or machine screws 77 that extend through apertures in the top connecting portion 50 and are threadably received into similar blind threaded mounting taps 79 of the upper end retaining portion 60. In this way, the actuator 42 is a separable component of the apparatus that may be readily detached for repair and replacement. A metal inertia plate 80 is disposed between the pressing plate 68 and the lower end retaining portion 62 of the actuator 42 and is fabricated of steel plate material. The inertia plate 80 adds about five pounds mass to the ram device during impact of the oil filter F to assist in crushing the filter F. As shown best in FIG. 5, the lower end retaining portion 62 of the actuator 42 extends substantially beyond the sides of the narrow pressing plate 68 and as such are not directly supported by the pressing plate 68. The steel inertia plate 80 extends between the left 70 and right 72 ends of the pressing plate 68 and then bulges outwardly between its ends to support substantially the entire lower end retaining portion 62 and serves to distribute the crushing force of the actuator 42 more evenly across the pressing plate 68 and to prevent the otherwise unsupported portions of the lower end retaining portion 62 from bending around the pressing plate under crushing load.

The actuating means 42 includes a two-way valve 82 having a supply inlet line 84, a return line 86 and a feed line 88. The supply line 84 is coupled to a source of pressurized actuating fluid (not shown) and the apparatus 10 is specifically designed to operate on low pressure shop air that is available in most automotive service stations and oil change facilities and is typically pressurized to about 110 p.s.i. line pressure. A control lever 90 of the valve 82 is normally maintained in an "off" position so as to direct the air through the return line 86 and prevent the pressurized air from entering the chamber 66 and actuating the ram device 40. The control lever 90 is movable to an "on" position causing the pressurized air to be directed into the chamber 66 through feed line 88 causing expansion of the flex member 64 and hence the chamber 66 which in turn displaces the lower end retaining portion 62 downwardly toward the base 14 and moves the ram device 40 from an initial raised unactuated position (shown in FIGS. 1 and 2) in which the crushing head 58 is spaced above the filter platform 16 sufficiently to enable an uncrushed oil filter F to be mounted on the platform 16 beneath the crushing head 58 to a lowered actuated position (shown in FIGS. 3 and 5) in which the ram device 40 is downwardly displaced toward the base 14 causing the crushing head 58 to advance further toward the filter platform 16 so as to crush the oil filter F between the crushing head 58 and the filter platform.

A preferred air spring actuator 42 is available commercially through Endins, Inc. and is a double convolute bellows-type air spring which produces approximately 9500 pounds pressing force with conventional 110 p.s.i. shop air input and imparts approximately six inches of stroke to the ram device, which is sufficient to accommodate and crush most replaceable-type automotive and light truck oil filters.

The crushing frame 12 includes a ram rod support portion 92 welded or otherwise secured to the leg portions 46, 48 of the U-shaped tubular member 44 intermediate the top connecting portion 50 and the base portion 14 and extending horizontally inwardly of the leg portions 46, 48 toward the ram rod device 40 and slidably guiding and supporting the ram rod 52 during vertical movement thereof between the unactuated and actuated positions. The ram rod support portion 92 includes a pair of front 94 and back 96 cross members constructed of square tubular metal stock material and are welded or otherwise rigidly secured to the left 46 and right 48 leg portions of the U-shaped tubular member 44 so as to extend horizontally therebetween on opposite front and back sides of the ram rod 52. The ram rod support portion 92 includes a guide member 98 connected to the cross members 94, 96 and spanning a gap between the cross members 94, 96 such that the ram rod support portion 92 completely surrounds the ram rod 52 between the pressing plate 68 and the crushing head 58. The ram rod support portion 92 includes a central passageway 100 formed in the guide member 98 and through which the ram rod 52 extends. A low friction sleeve-like bearing or bushing 102 is disposed in the passageway 100 and surrounds the ram rod 52 to provide a low friction bearing surface between the ram rod 52 and the ram rod support portion 92. The bearing 102 is preferably self-lubricating and able to withstand any lateral loads imparted to the ram rod 52. A preferred bearing is available commercially through Gatlock Bearings, Inc. and is sold under the brand name DU. The ram rod support portion 92 provides lateral stability to the ram device 40 enabling usage of the single ram rod 52 so as to simplify construction and reduce cost.

The apparatus 10 includes return means 104 reacting between the ram device 40 and the frame 12 in opposition to the air spring actuator 42 for constantly urging the ram device 40 upwardly toward the unactuated raised position. The return means 104 comprises a pair of left 106 and right 108 spring loaded telescopic guides disposed on opposite sides of the ram rod 52 and reacting between the pressing plate 68 of the ram device 40 and the base portion 14 of the frame 12 to constantly urge the ram device 40 upwardly. Each of the telescopic guides 106, 108 includes a cylindrical guide tower or sleeve 110, a cylindrical plunger rod 112 extending into the sleeve, and a compression coil spring 114 carried about the plunger rod 112 and extending into the sleeve 110. As best shown in FIG. 2, the plunger rods 112 are secured to the corresponding left 70 and right 72 ends of the pressing plate 68 by machine screws 115 and from there extend vertically downwardly toward the base portion 14 of the frame 12. The telescopic guides 106, 108 are spaced inwardly of the leg portions 46, 48 of the U-shaped tubular member 44.

The guide sleeves 110 are welded or otherwise secured to the base portion 14 and extend vertically upwardly therefrom in the gap between the front 94 and back 96 cross members. The guide sleeves 110 are further welded or otherwise secured to the ram rod support portion 92 and in the first embodiment are joined directly to the cross members 94, 96. A lower end of the guide sleeves 110 is rolled inwardly to form a spring seat flange or lip 116. The coil springs 114 have lower ends which are seated in the spring seats 116 and an upper ends which bear against an underside of the pressing plate 68. The plunger rods 112 extend into upper open ends of the guide sleeves 110 and are slidably supported by the sleeves 110 during movement of the ram device 40. The coil springs 114 react between the spring seat 116 and the pressing plate 68 to constantly urge the ram device 40 upwardly to the unactuated position. Upon actuation of the ram device 40, the plunger rods 112 are caused to extend further into the guide sleeves 110 increasing the compression load on the springs 114. Upon deactuation of the ram device 40, the springs 114 recoil and return the ram device to the raised unactuated position.

The apparatus 10 may optionally include filter sidewall deforming means 118 movable transversely of the ram device 40 for engaging and inwardly deforming the sidewalls of the oil filter F to reduce the initial peak resistance to end-to-end crushing offered by the oil filter F. More specifically, the upstanding sidewalls of the oil filter F offer a predetermined peak resistance to end-to-end crushing of the filter F which must be overcome before initial end-to-end crushing of the filter F can commence. The filter sidewall deforming means 118 inwardly deforms or kinks the sidewall of the filter F prior to crushing in order to decrease the peak resistance to crushing force offered by the filter, thereby lessening the pressing force required to crush the filter F. The filter sidewall deforming means 118 is operatively coupled to the ram device 40 for imparting the transverse movement to the filter sidewall deforming means 118 in response to the downward movement of the ram device 40 toward the base 14.

Figure 8:
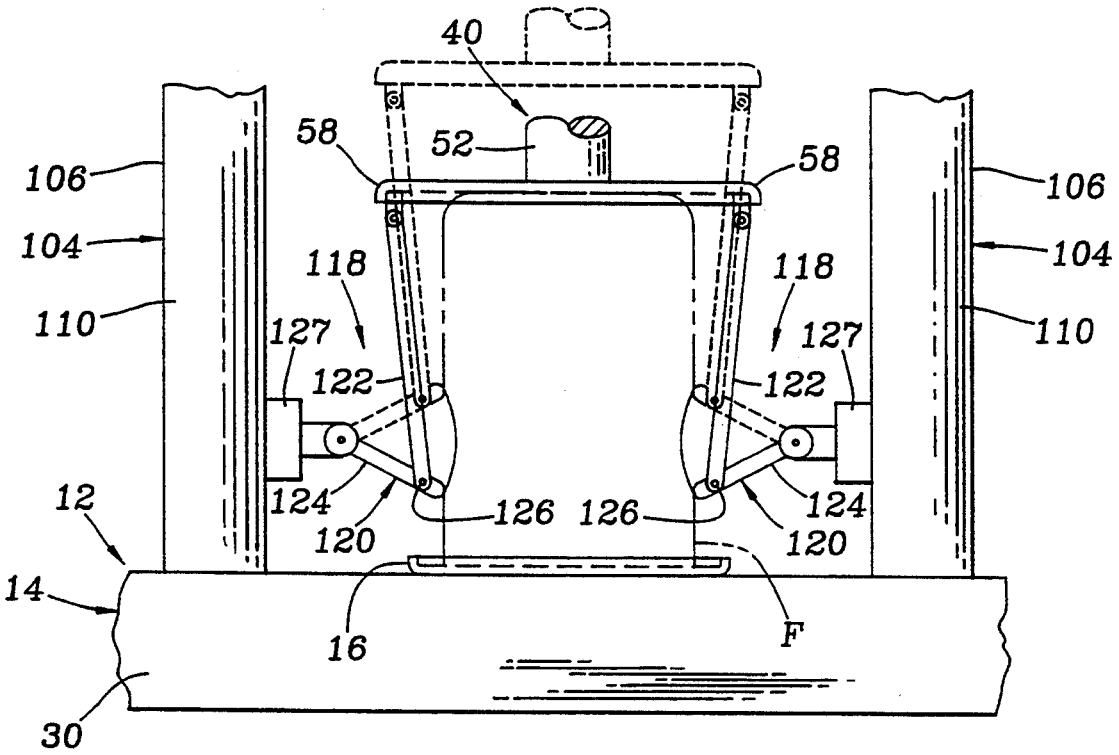
FIGS. 8 and 9 are fragmentary front elevation views showing alternative embodiments of the filter sidewall crushing feature.
Figure 9:
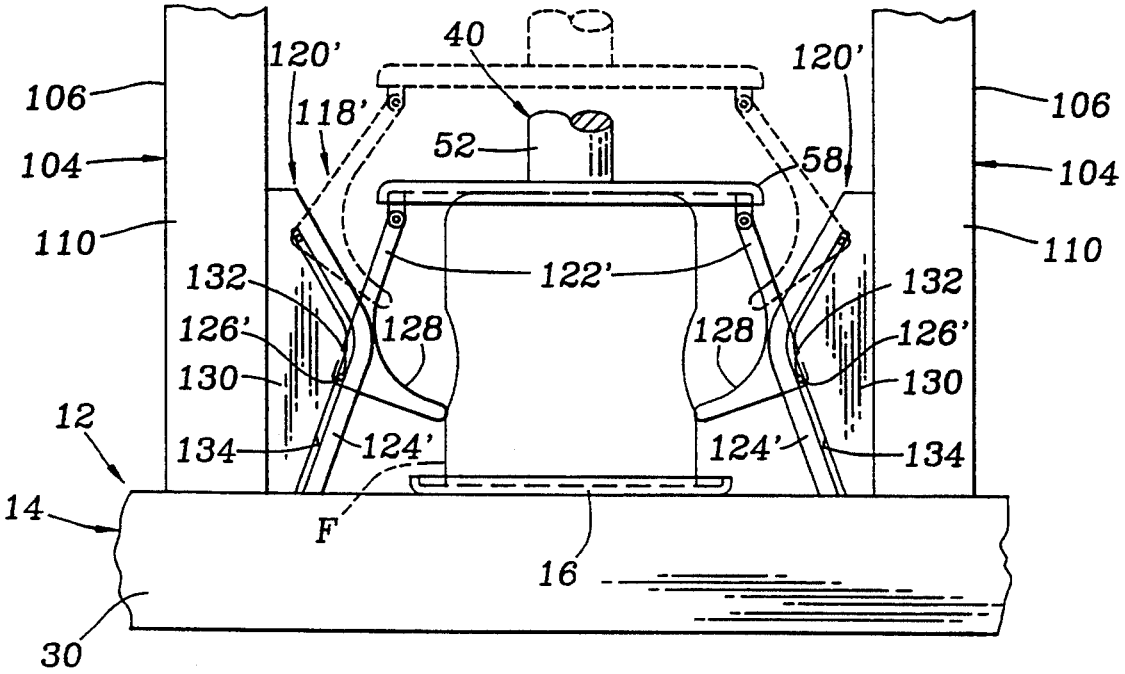

Two embodiments of the filter sidewall deforming means 118 are shown in FIGS. 8 and 9, respectively, and each includes a pair of linkage mechanisms 120, 120' disposed on opposite sides of the ram rod 52 and each includes a first link member 122, 122' connected to the crushing head 58 of the ram device 40, a second link member 124, 124' operatively connected to the crushing frame 12, and an interconnection 126, 126' between the first 122, 122' and second 124, 124' link members.

In the embodiment of FIG. 8, the first link members 122 are pivotally connected to the crushing head 58 on opposite left and right sides of the ram rod 52 and extend generally vertically downwardly therefrom toward the base on either side of the filter F. The second link members 124 are pivotally connected at one end to a support block 127 mounted on the guide sleeves 110 and from there extend inwardly toward the ram rod 52. The interconnection 126 between the first link members 122 and second link members 124 comprises a pivot connection such that downward movement of the ram device 40 produces downward pivotal movement of the second link member 124 forcing an inwardmost end of the second link members 124 along an inwardly arching path which in turn engages and inwardly deforms the side walls of the oil filter F to produce a dent or deformation prior to commencement of end-to-end crushing. The linkage mechanism 120 is designed to swing free of the oil filter F once end-to-end crushing commences so as to not interfere with the crushing operation. An initial position of the ram device 40 and the linkage mechanisms 120' is shown in phantom in FIG. 8 and the position of the ram device 40 and linkage mechanisms 120' following deformation of the sidewalls of the filter F is shown in solid lines but before commencement of end-to-end crushing.

The linkage mechanisms 120' of FIG. 9 are similar in that the first link members 122' are pivotally connected to the crushing head 58 and extend generally downwardly toward the base 14. The first link members 122', however, are generally L-shaped and include a filter-engaging foot portion 128 projecting inwardly toward one another on either side of the filter F. The second link members 124' comprise a cam plate 130 welded or otherwise secured to the guide sleeves 110 and the interconnection 126' between the first link members 122' and second link members 124' comprises follower pins 132 projecting from the first link members 122' and received in cam slots 134 of the second link members 124'.

As the ram device 40 moves from the initial raised unactuated position (shown in phantom lines in FIG. 9) downwardly toward the base to a position just prior to commencement of end-to-end crushing of the filter F (shown in solid lines), the interaction between the follower pins 132 and cam slots 134 causes the first link members 122' to extend initially inwardly toward one another to engage and inwardly deform the filter and then outwardly from one another so as to not interfere with the end-to-end crushing operation of the ram device 40.

The apparatus 10 may be simply placed on a support surface (not shown) during use or may be provided with one or more mounting features to enable the apparatus 10 to be mounted on a wall, an oil collection barrel, a table top, or supported off the floor, as will be explained in greater detail below.

The crushing frame 12 may optionally include wall mounting means 136 for mounting the apparatus on a wall. The wall mounting means 136 may include one or more mounting holes or apertures 138 provided in one or both of the leg portions 46, 48 of the U-shaped tubular member 44 as shown in FIGS. 1 and 2 for receiving suitable fasteners or other mounting hardware to secure the apparatus 10 to the wall.

The wall mounting means 136 may also include a mounting bracket 140 secured to the frame for connection with a suitable mounting fixture (not shown) secured to the wall. As shown in FIGS. 1 and 4, the mounting bracket 140 may be secured to one of the cross members 94 or 96 and may comprise a generally U-shaped metal member welded or otherwise secured to the frame 12 and having a pair of outwardly projecting mounting tabs or ears 142 provided with mounting holes 144 for attachment to the wall fixture (not shown). The apparatus 10 may be provided with one or both embodiments of the wall mounting means 136.

The frame 12 may also include, either alternatively or in addition to the wall mounting means 136, barrel mounting means in the preferred form of apertures 146 similar to those of the wall mounting means 136 but extending through either one or both of the tubular mounting members 30, 32 of the base portion 14 for receiving fasteners or other suitable mounting hardware for mounting the apparatus 10 to an oil collection barrel or drum (not shown).

The apparatus 10 may be further provided with floor stand support means or a floor stand 148 for engaging the mounting members 30, 32 of the base portion 14 and supporting the crushing apparatus 10 off the floor or other equivalent support surface S.

Figure 3:
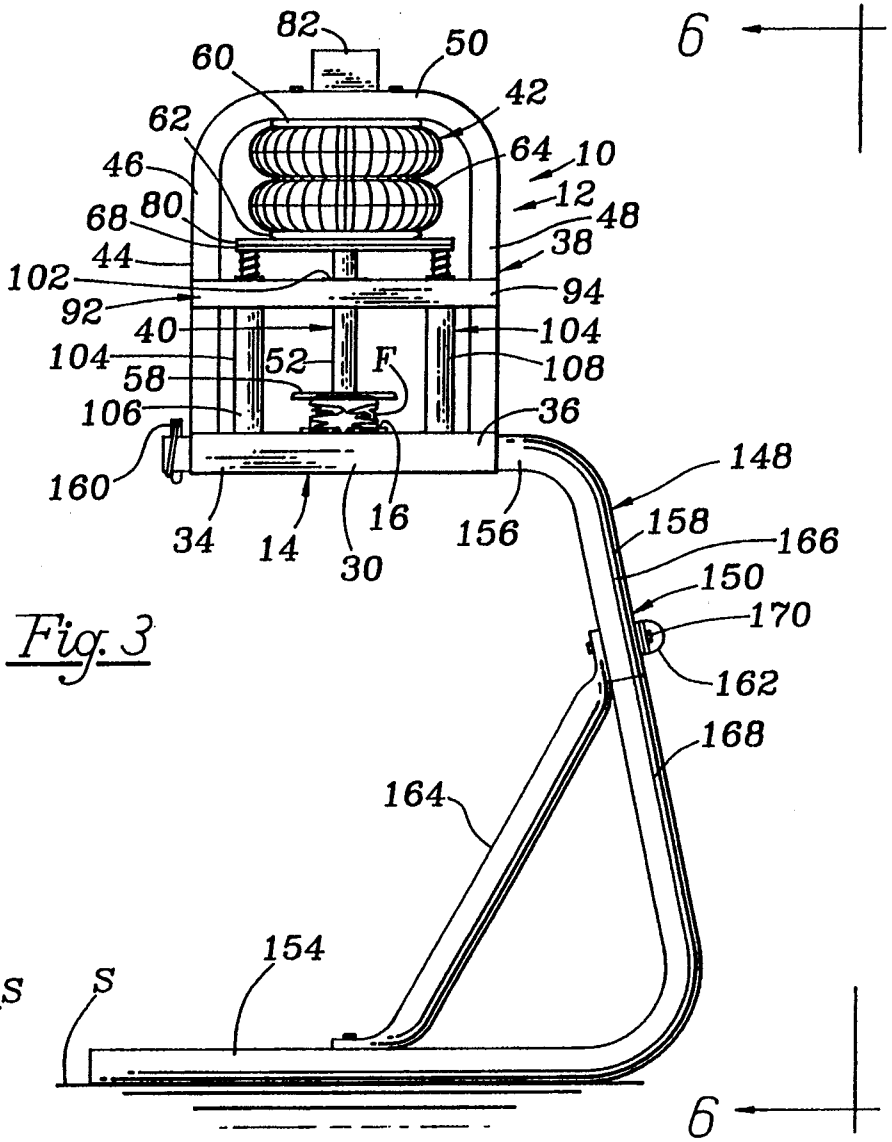
FIG. 3 is a front elevation view of the press of FIG. 1 shown supported by a floor stand.
Figure 6:
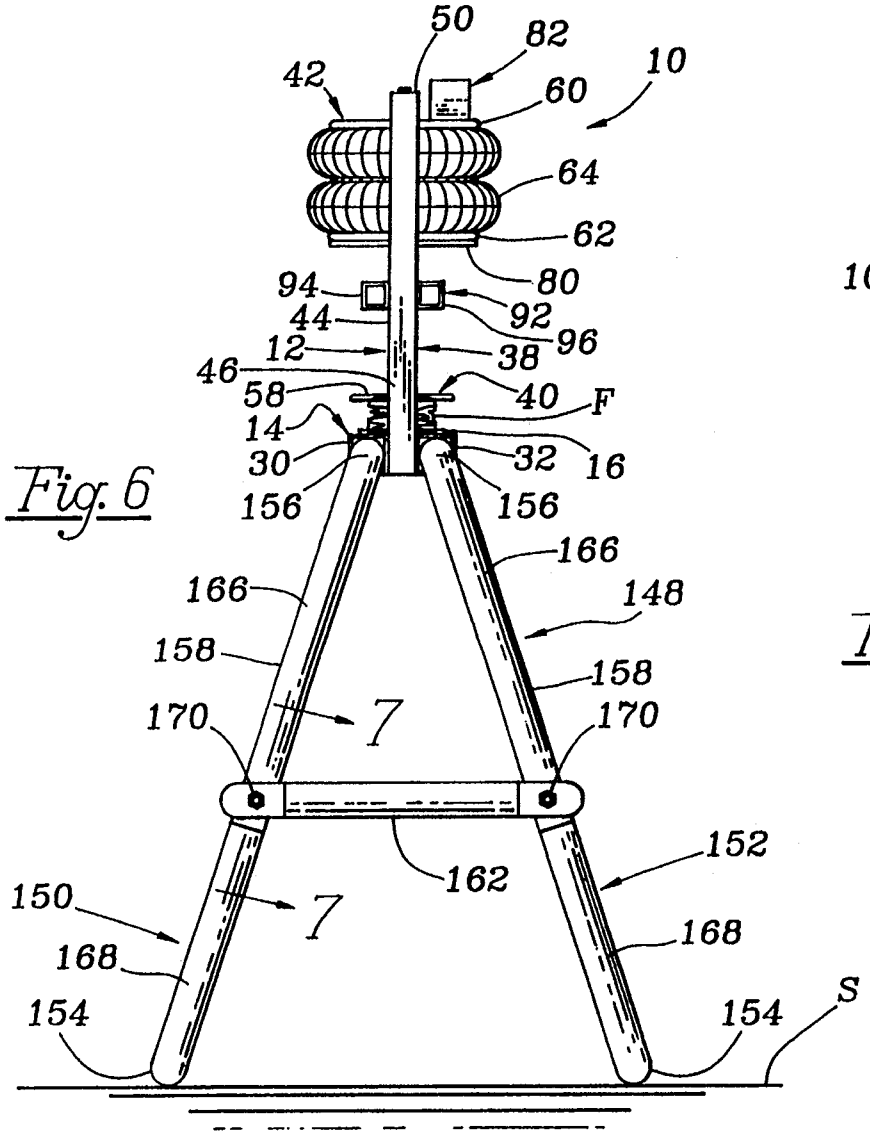
FIG. 6 is a side elevation view of the press and stand along lines 6—6 of FIG. 3.
Figure 5:
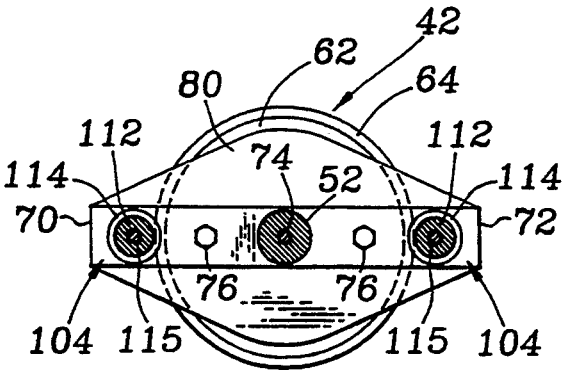
FIG. 5 is a side elevation view taken along lines 5—5 of FIG. 3.

As shown in FIGS. 3 and 6, a first embodiment of the floor stand 148 comprises a pair of leg members 150, 152 that are generally C-shaped with each having a lower horizontally extending foot portion 154 for contacting the support surface S, a generally horizontal support arm portion 156 above the foot portion 154, and an upstanding leg portion 158 extending between and interconnecting the foot 154 and support arm 156 portions. The C-shaped members 150, 152 are preferably fabricated of round tubular metal stock material and the support am portions 156 are dimensioned to be extended into the tubular mounting members 30, 32 of the frame 12. A free end of the support arms 156 may extend beyond the mounting members 30, 32 when the crushing apparatus 10 is mounted on the floor stand 148 and a retainer pin 160 may be provided to one or both of the support arm portions 156 to retain the crushing apparatus 10 secured to the floor stand 148. Upon removal of the retainer pin 160, however, the crushing apparatus 10 is separable from the floor stand 148 by simply removing the support am portions 156 from the mounting members 30, 32.

As shown best in FIG. 6, the C-shaped members 150, 152 are connected to one another by a crosspiece or cross member 162 to support the C-shaped members 150, 152 in a downwardly diverging A-shaped arrangement when viewed from the side to provide lateral stability to the floor stand 148. A stabilizing member 164 extends between the leg portion 158 and foot portion 154 of each of the C-shaped members to provide fore and aft stability to the floor stand 148.

Figure 7:
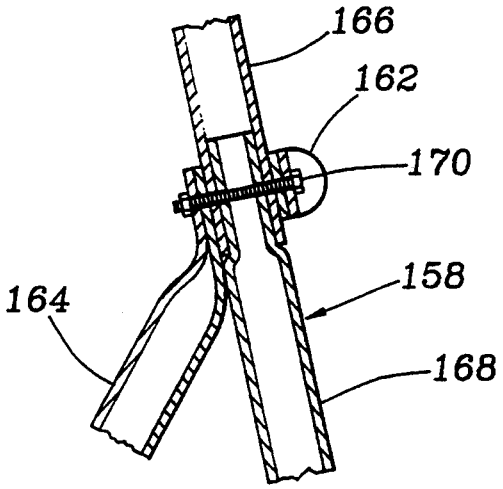
FIG. 7 is a fragmentary sectional view taken along lines 7—7 of FIG. 6.

The floor stand 148 of the first embodiment is preferably constructed so as to be collapsible. In particular, the crosspiece 162 and stabilizing member 164 are secured by fasteners so as to be separable from one another and further the leg portions 158 of each C-shaped member 150 and 152 are preferably formed as separable upper 166 and lower 168 sections, as best illustrated in FIG. 7. As shown, the lower leg sections 168 have a reduced diameter end portion that is extendable into an open end of the upper leg section 166. The crosspiece 162, stabilizing member 164, and upper and lower leg sections 166, 168 have coupling means comprising aligned apertures through which a common fastener 170 extends to secure the upper 166 and lower 168 leg sections as well as securing the crosspiece 162 and stabilizing members 164 to each of the leg portions 158. In this way, the fastener 170 couples the crosspiece 162 and stabilizing members 164 to the leg portions 158 while simultaneously coupling the upper 166 and lower 168 leg sections together.

Figure 15:
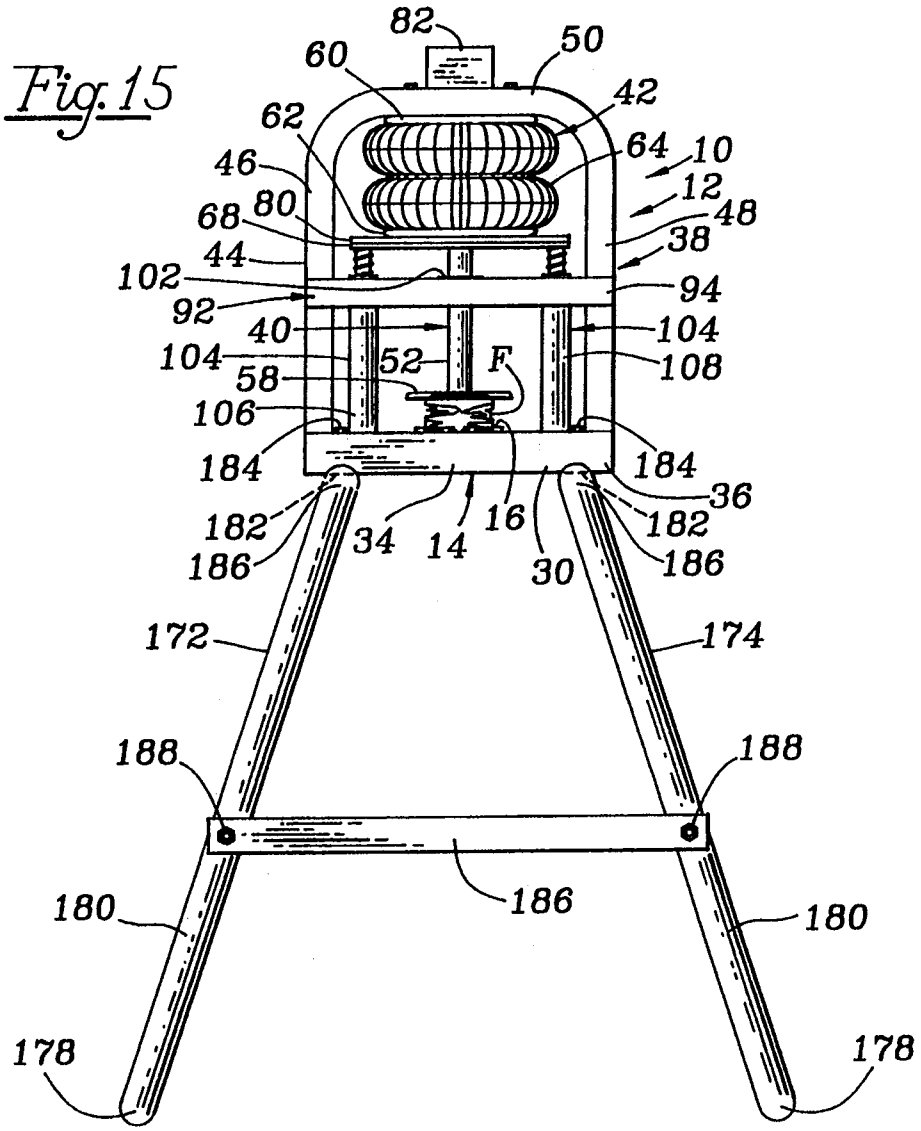
FIG. 15 is a front elevation view of the press and stand of FIG. 14.
Figure 14:
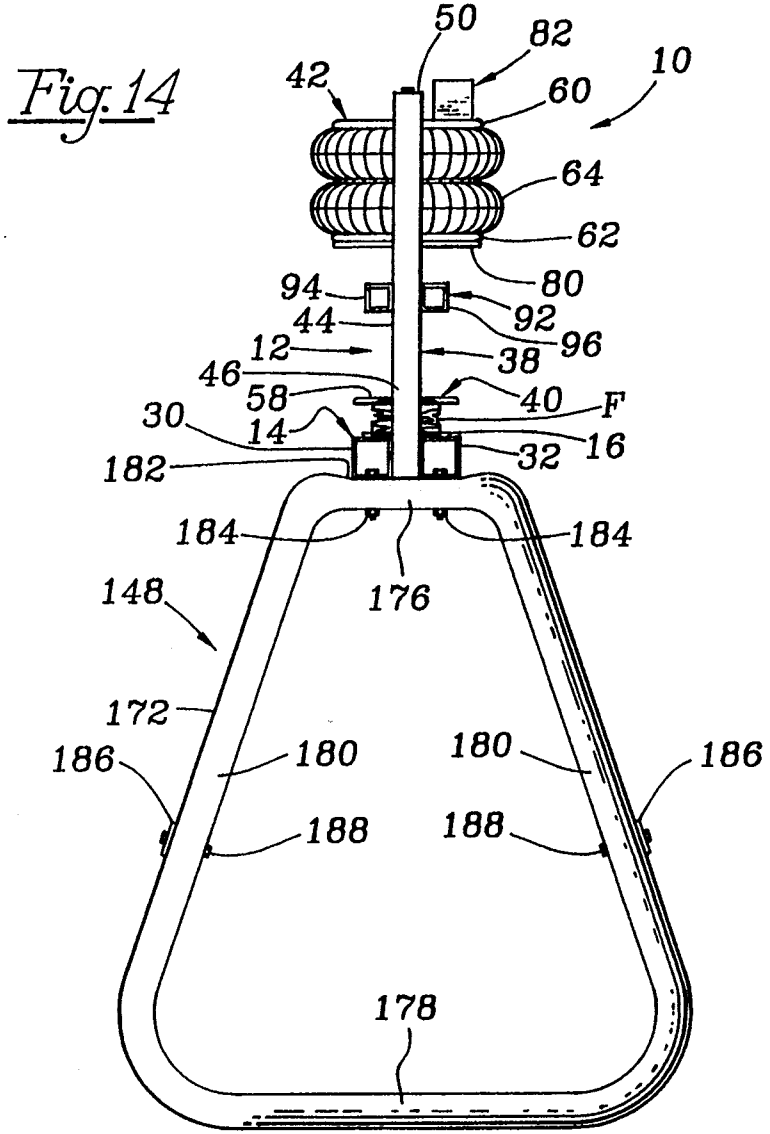
FIG. 14 is a side elevation view of an alternative floor stand shown supporting the press of FIG. 1.

FIGS. 14 and 15 show a second embodiment of the floor stand 148 similar to the floor stand of the first embodiment in that a pair of leg members 172, 174 constructed of tubular metal are provided and engage the mounting members 30, 32 of the base 14 for supporting the filter crushing apparatus 10 off the floor. The leg members 172, 174, however, are secured to a bottom side of the mounting members 30, 32 rather than having a portion extending into the mounting members 30, 32.

The leg members 172, 174 are each constructed of a single piece of tubular metal material formed in a closed-loop figure having a narrow horizontally disposed upper press engaging portion 176, a relatively wider horizontally disposed lower floor engaging portion 178 and a pair of downwardly diverging integral connecting portions 180 integrally joining the press engaging portion 176 and floor engaging portion 178. Each of the press engaging portions 176 has a flattened region 182 for receiving the mounting members 30, 32 of the press 10 as shown best in FIG. 14. One or more fasteners 184 secure the press 10 to the leg members 172 174. The flattened regions 182 are offset by approximately 14° with respect to vertical such that the leg members 172, 174 extend in a downwardly diverging manner from the press 10 of approximately 28°. A pair of stabilizing cross members 186 extend between the leg members 172, 174 to provide stability to the floor stand. The cross members 186 are secured to the leg members 172, 174 by suitable fasteners 188. Of course, other offset angles of the flattened regions 182 may be utilized to suit a particular need.

Figure 16:
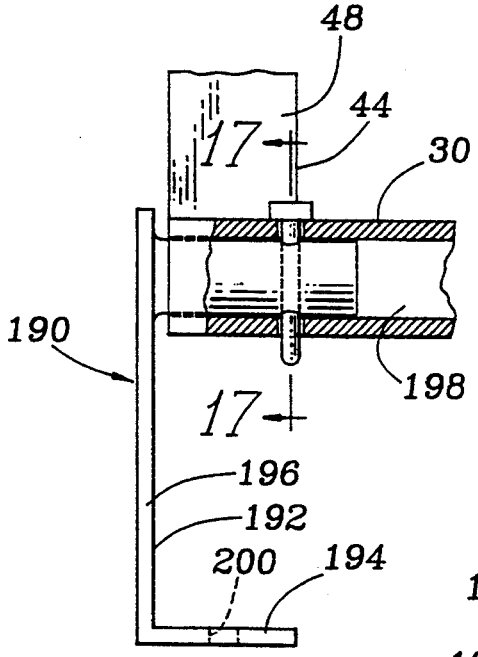
FIG. 16 is a fragmentary front elevation view of the table top stand shown supporting the filter press of FIG. 1.
Figure 17:
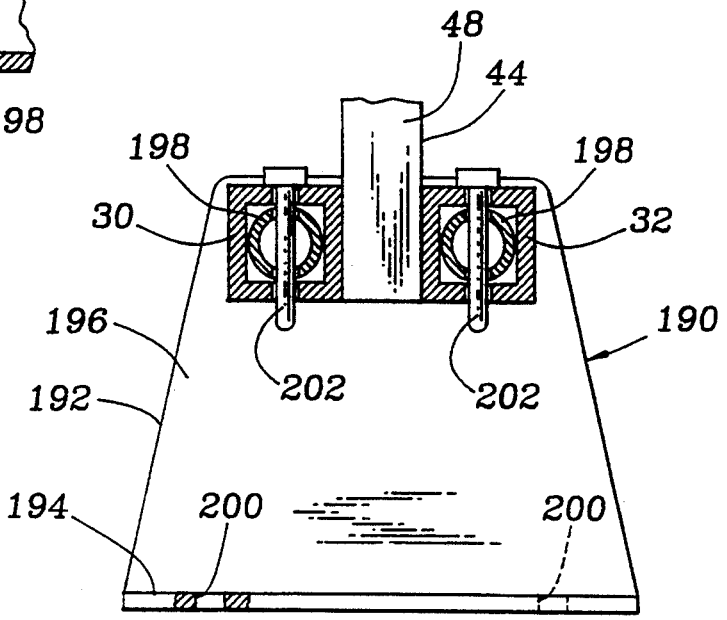
FIG. 17 is a sectional view taken along lines 17—17 of FIG. 16.

The filter crushing apparatus 10 may further include tabletop mounting means in the preferred form of a tabletop mounting stand 190 for mounting the filter crushing press 10 on a tabletop. The tabletop mounting stand 190 is illustrated in FIGS. 16 and 17 and includes a generally L-shaped support member 192 having a horizontal base portion 194, a vertical leg portion 196 and a pair of support arms 198 projecting horizontally from the vertical leg portion 196 for extension within an open end of the mounting members 30, 32 of the filter press 10, as shown in FIGS. 16 and 17. The base portion 194 may be provided with one or more apertures 200 for receiving suitable fasteners (not shown) for securing the mounting stand 190 to a tabletop (not shown). As shown in FIG. 16, the support arms 198 extend only part way into the mounting members 30, 32 of the press 10 and the mounting members 30, 32 and support arms 198 are provided with aligned apertures through which a retaining pin 202 may be extended to secure the filter press 10 against inadvertent removal from the mounting stand 190.

Another embodiment of the oil filter crushing press apparatus is shown in FIGS. 10–13 and is indicated generally by the reference numeral character 310. Like the previously described crushing apparatus 10, the crushing apparatus 310 includes a crushing frame 312 having a base portion 314 mounting an apertured oil filter platform 316 on which an oil filter F′ may be supported on end in the manner previously described. The filter platform 16 may be of the same type as described previously with respect to the crushing apparatus 10.

The base portion 314 similarly includes a pair of front 330 and back 332 mounting members 318, 320 that extend horizontally and are spaced from one another. The mounting members 318, 320 are likewise fabricated of square metal tubing.

The crushing frame 312 also includes an upper support frame portion 322 that functions the same as that described with respect to the prior crushing apparatus 10 but instead includes a pair of U-shaped tubular members rather than one. Like the previously described apparatus 10, each of the U-shaped members 324, 326 includes left and right leg portions 328, 330, respectively, and a top connecting portion 332. The U-shaped members 324, 326 are likewise welded or otherwise secured to the base portion 314 with the leg portions 328, 330 projecting vertically upwardly to support the top connecting portion 332 above the base portion 314 of the frame 312.

Figure 10:
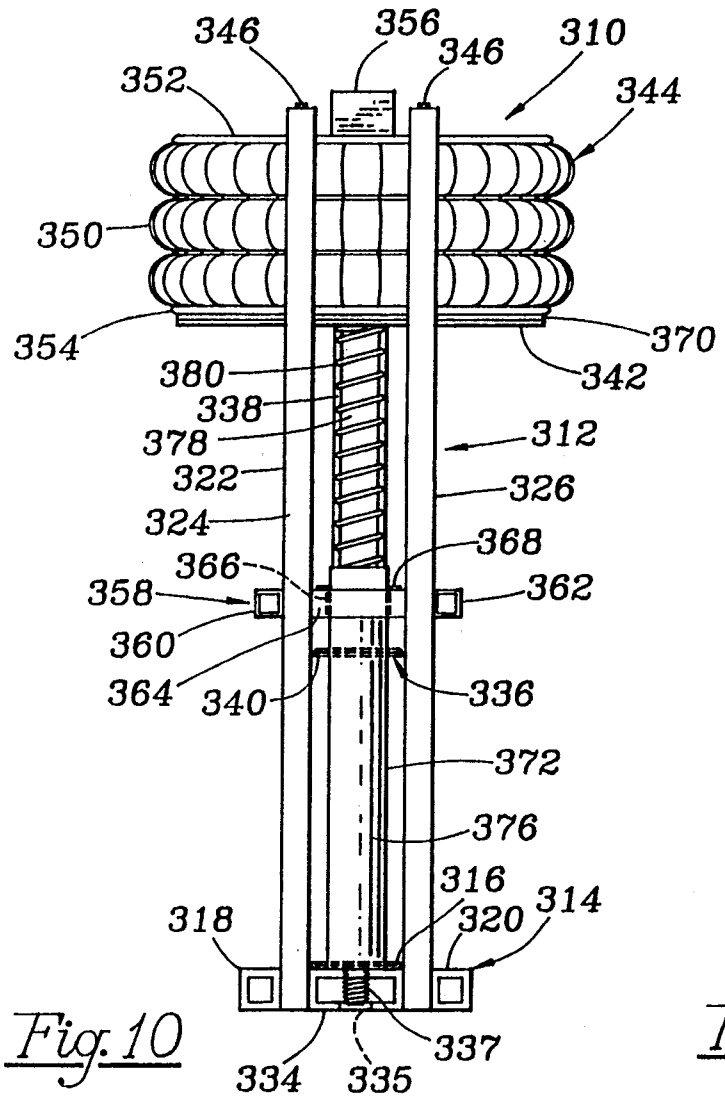
FIG. 10 is a side elevation view of an alternative embodiment of the oil filter press.

The U-shaped members 324, 326 are spaced from one another and the base portion 314 is provided with an additional rectangular tubular men, her 334 provided between the U-shaped members 324, 326 and extending generally horizontally between the left 328 and right 330 leg portions in the same general plane as the front 318 and back 320 mounting members, as best seen in FIG. 10. The filter platform 316 is mounted on the rectangular tubular member 324 approximately midway between the left 328 and right 330 leg portions of the U-shaped members 324, 326 and the member 334 may be provided with a through hole 335 to provide access to an oil drainage fitting 337 similar to that shown at 24 and described with respect to the crushing apparatus 10.

The apparatus 310 includes a similar ram device 336 having a single central ram rod 338 with a crushing head 340 mounted to a lower end thereof and a pressing plate 342 mounted to an upper end thereof. The ram device 336 is of the same construction as that described with respect to the apparatus 10 except that the ram rod 338 is larger in diameter to sustain greater crushing loads and has an increased length to provide greater travel or stroke to the ram device 336.

A similar air spring-type actuating device 344 is mounted to the top connecting portions 332 of the U-shaped members 324, 326 with fasteners 346 in the same manner as previously described and likewise to the pressing plate 342 of the ram device 336 by fasteners 348. The actuating device 344 of the crushing apparatus 310 is simply a larger version of the actuating device 42 described previously with respect to the crushing apparatus 10 and is available through the same manufacturer. The difference is that the flex member 350 is a triple convolute billows-type member to provide an increased stroke and the upper 352 and lower 354 end retaining portions are larger in diameter to provide approximately 18,000 pounds pressing force to the ram device 336. The apparatus 310 is specifically designed to crush relatively large oil filters of the same general type but used on large trucks and other heavy equipment. Such filters offer even a greater peak resistance to crushing and are more suitably handled by the heavy duty filter crushing apparatus 310. A control valve 356 is likewise provided to control the flow of the same pressurized fluid into the actuating device 344 in the same manner previously described.

Figure 12:
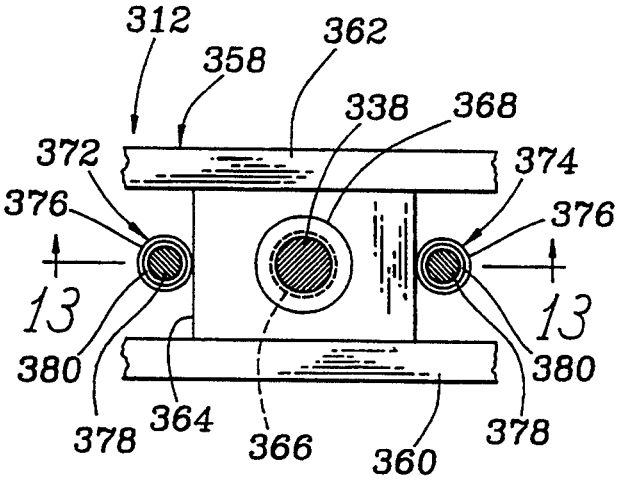
FIG. 12 is a fragmentary cross-sectional view taken along lines 12—12 of FIG. 11.
Figure 13:
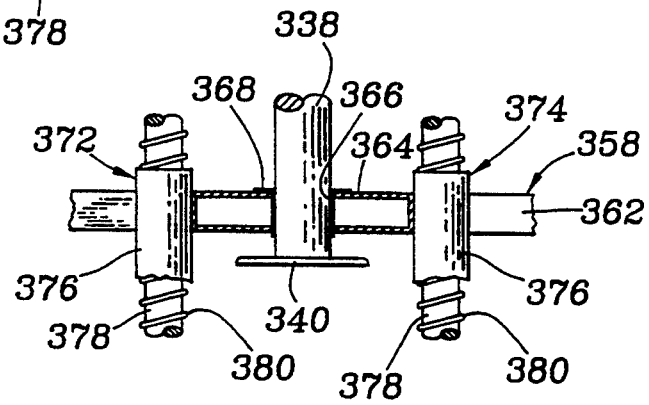
FIG. 13 is a fragmentary sectional view taken along lines 13—13 of FIG. 12.

The crushing frame 312 also includes a ram rod support portion 358 welded or otherwise rigidly secured to the leg portions 328, 330 of the U-shaped members 324, 326 and slidably supporting the ram rod 338 between its ends to provide lateral support to the ram rod in the same manner as previously described. The ram rod support portion 358 likewise includes a pair of front 360 and back 362 cross members of square metal tubular construction extending horizontally between and welded or otherwise fixedly secured to the left 328 and right 330 leg portions of the front 324 and back 326 U-shaped members, respectively, as shown. The cross members 360, 362 are spaced from one another and a transverse guide member 364 extends between and is secured to the cross members 360, 362 as best shown in FIGS. 12 and 13. The guide member 364 is preferably of rectangular tubular construction and has a central passageway 366 through which the ram rod 338 extends and in which a similar low friction bushing or sleeve 368 is mounted for surrounding the ram rod 338, as shown in FIGS. 12 and 13.

Figure 11:
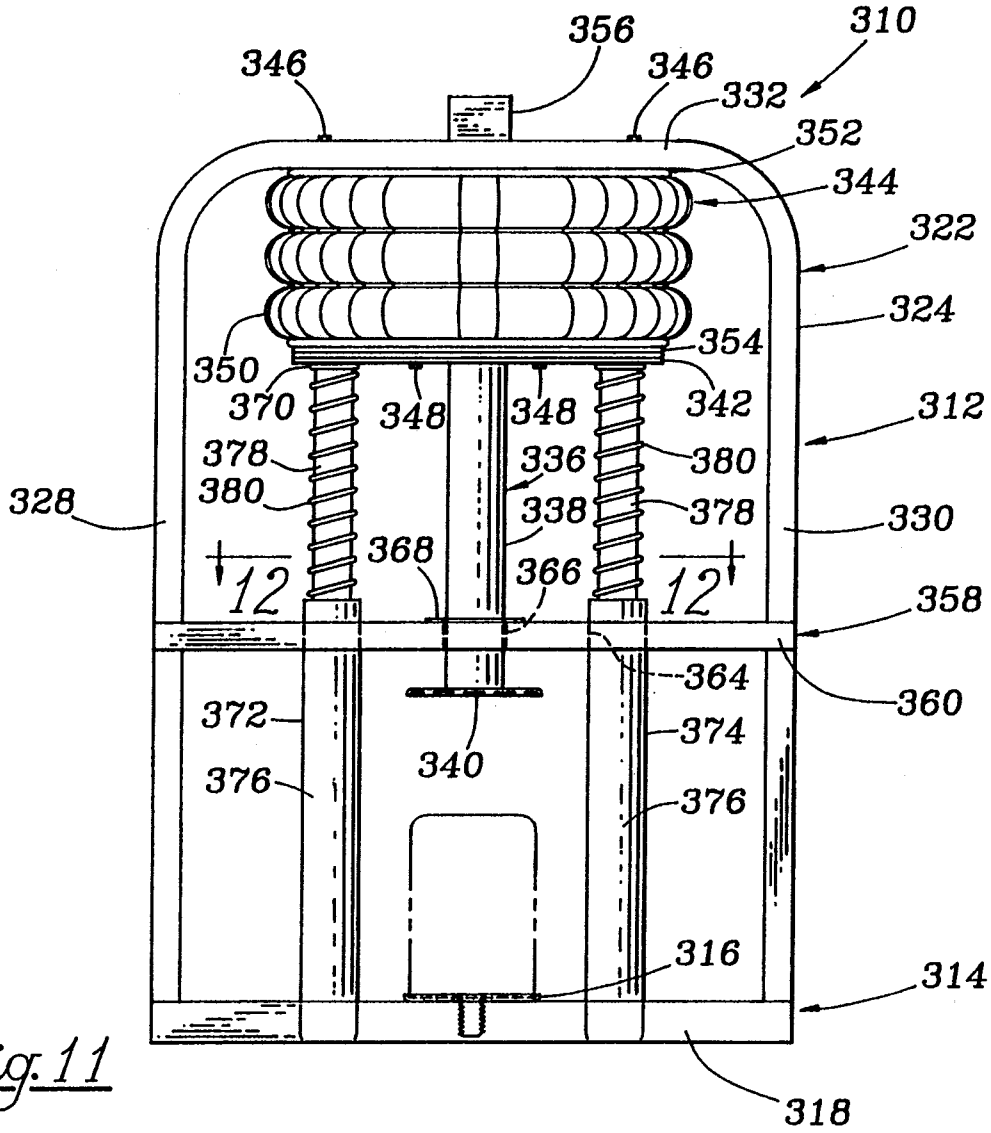
FIG. 11 is a front elevation view of the press of FIG. 10.

The apparatus 310 also includes an inertia plate 370 of the same general type as the inertia plate 80 described above and the same type of left and right telescopic spring-loaded guides 372, 374 each having each having a guide sleeve 376, a plunger rod 378, and a compression spring 380 of the same construction as described previously. As shown in FIGS. 10 and 11, the guide sleeves 376 are supported by the rectangular base portion 334 and extend vertically upwardly therefrom between the front 360 and back 362 cross members and are welded or otherwise secured to opposite sides of the guide member 364 as shown in FIGS. 12 and 13.

The operation of the crushing apparatus 310 is identical to that described with respect to the crushing apparatus 10 and may likewise include the same wall mounting and barrel mounting features described above and may be mounted on the same type of floor stands and table top stands described above with respect to the first embodiment of the filter press 10. The apparatus 310 may also include the same filter side wall deforming means 118 as described above.

While the invention has been described in terms of specific preferred embodiments thereof, it is not intended to be limited thereto but rather only to the extent set forth hereafter in the following claims.

I claim:

1. An apparatus for crushing used oil filters to reclaim residual oil therefrom before disposing of the filters, said apparatus comprising:

a rigid crushing frame (12, 212) having a base (14, 314) for supporting an oil filter (F) on end;

a ram device (40, 336) having a rod (52, 338) slidably supported by said frame (12, 312) for longitudinal movement toward and away from said base (14, 314) and a crushing head (58, 340) secured to a lower end of said rod above said base (14, 314) for engaging and crushing the oil filter (F);

self-contained air spring actuating means (42, 344) having a rigid upper end retaining portion (62, 352) secured to said frame (12, 312), a rigid lower end retaining portion (62, 354) secured to said ram device (40, 336), and an intermediate elastic flex member (64, 350) extending between and interconnecting said retaining portions and defining an enclosed expandable chamber therein for selectively receiving a pressurized actuating fluid therein causing said actuating means (42, 344) to expand and react between said frame (12, 312) and said ram (40, 336) and thereby displacing said crushing head (58, 340) from a raised unactuated position forcibly toward said base (14, 314) to a lowered actuated position to crush the filter (F) interposed between said crushing head (58, 340) and said base (14, 314), said ram device (40, 336) including a pressing plate (68, 342) secured to an upper end of said ram rod (52, 338) and to said lower end retaining portion (62, 354) of said actuating means (42, 344), and including return means reacting between said ram device (40, 336) and said frame (12, 312) in opposition to said actuating means (42, 344) for constantly urging said ram (40, 336) toward said raised unactuated position, said return means comprising a pair of telescopic guides (106, 108; 32, 374) disposed on opposite sides of said ram rod (52, 338) and each including a plunger rod (112, 378) secured to one of said pressing plate (68, 342) and said base (14, 314), a guide sleeve (110, 376) secured to the other of said pressing plate (68, 342) and said base (14, 314) and slidably receiving said plunger rod (112, 378), and a compressing spring (114, 380) carried about said plunger rod (112, 378).

2. The apparatus of claim 1 further characterized by said crushing frame (12, 312) including at least one U-shaped tubular member (44; 324, 326) having a pair of left and right upstanding leg portions (46, 48; 328, 330) secured at free ends thereof to said base member (14, 314) and a horizontally disposed top connecting portion (50, 332) spaced above said base (14, 314) and integrally joining opposite ends of said leg portions (46, 48; 328, 330).

3. The apparatus of claim 2 further characterized by said upper end retaining portion (60, 352) being secured to said top connecting portion (50, 332) of said U-shaped tubular member (44; 324, 326).

4. The apparatus of claim 2 further characterized by said frame (12, 312) including a ram rod support portion (92, 358) secured to said leg portions (46, 48; 328, 330) intermediate said top connecting portion (50, 332) and said base (14, 314) and slidably supporting said ram rod (52, 338) for providing lateral support to said ram rod (52, 338) during said movement.

5. The apparatus of claim 4 further characterized by said ram rod support portion (92, 358) being of tubular construction.

6. The apparatus of claim 4 further characterized by said ram rod support portion (92, 358) including a passageway (100, 366) through which said ram rod (52, 338) extends and a low friction bushing (102, 368) mounted in said passageway (100, 366) and surrounding said ram rod (52, 338).

7. The apparatus of claim 4 further characterized by said ram rod support portion (92, 358) engaging said ram rod (52, 338) intermediate said crushing head (58, 340) and said pressing plate (68, 342).

8. The apparatus of claim 4 further characterized by said base (14, 314) including a pair of mounting members (30, 32; 318, 320) of tubular construction.

9. The apparatus of claim 8 further characterized by said frame including barrel mounting means (146) for mounting said apparatus to an oil collection barrel.

10. The apparatus of claim 9 further characterized by said barrel mounting means (146) comprising mounting apertures (146) extending through at least one of said mounting members (30, 32; 318, 320) of said base (14, 314) for receiving fasteners for mounting to the oil collection barrel.

11. The apparatus of claim 2 further characterized by including a pair of said U-shaped tubular members (324, 326).

12. The apparatus of claim 1 further characterized by said actuating means (42, 344) including means (82, 356) for connecting said actuating means (42, 344) to a source of pressurized air.

13. The apparatus of claim 1 further characterized by said base (14, 314) including an oil filter platform (16, 316) for supporting and positioning the oil filter (F) and a drain hole aperture (22) extending through said platform (16, 316) for draining the residual oil from the filter (F) upon crushing.

14. The apparatus of claim 1 further characterized by including filter side wall deforming means (118, 118') movable transversely of said ram (40, 336) for engaging and inwardly deforming a side wall of the oil filter (F) to reduce end-to-end resistance to crushing of the oil filter (F).

15. The apparatus of claim 14 further characterized by said filter side wall deforming means (118, 118') being operatively coupled to said ram (40, 336) for imparting said transverse movement to said filter side wall deforming means (118) in response to said downward movement of said ram (40, 336) toward said base (14, 314).

16. The apparatus of claim 15 further characterized by said filter side wall deforming means (118) comprising at least one linkage mechanism (120, 120') including a first link member (122, 122') connected to said crushing head (58, 340), a second link member (124, 124') operatively connected to said frame (12, 312), and an interconnection (126, 126') between said first (122, 122') and said second (124, 124') link members.

17. The apparatus of claim 16 further characterized by including a pair of said linkage mechanisms (120, 120') disposed on opposite sides of said ram rod (52, 338).

18. The apparatus of claim 16 further characterized by said first link member (122) being pivotally connected to said crushing head (58), said second link member (124) being pivotally connected to said frame (12), and said interconnection (126) between said first links comprising a pivot connection.

19. The apparatus of claim 16 further characterized said first link member (122') being pivotally connected to said crushing head (340), said second link member (124') being fixed to said frame (312), and said interconnection (126') between said first (122') and said second (124') link members comprising a cam slot (134) formed in one of said first (122') and said second (124') link members and a follower pin (132) carried by the other of said first (122') and said second (124') link members and received in said slot (134) whereby said movement of said ram (40, 336) imparts said transverse movement to said filter side wall deforming means (118').

20. An apparatus for crushing used oil filters to reclaim residual oil therefrom before disposing of the filters, said apparatus comprising:

a rigid crushing frame (12, 212) having a base (14, 314) for supporting an oil filter (F) on end;

a ram device (40, 336) having a rod (52, 338) slidably supported by said frame (12, 312) for longitudinal movement toward and away from said base (14, 314) and a crushing head (58, 340) secured to a lower end of said rod above said base (14, 314) for engaging and crushing the oil filter (F); said crushing frame (12, 312) including at least one U-shaped tubular member (44; 324, 326) having a pair of left and right upstanding leg portions (46, 48; 328, 330) secured at free ends thereof to said base member (14, 314) and a horizontally disposed top connecting portion (50, 332) spaced above said base (14, 314) and integrally joining opposite ends of said leg portions (46, 48; 328, 330), and including a ram rod support portion (92, 358) secured to said leg portions (46, 48; 328, 330) intermediate said top connecting portion (50, 332) and said base (14, 314) and slidably supporting said ram rod (52, 338) for providing lateral support to said ram rod (52, 338) during said movement;

self-contained air spring actuating means (42,344) having a rigid upper end retaining portion (62, 352) secured to said frame (12, 312), a rigid lower end retaining portion (62, 354) secured to said ram device (40, 336), and an intermediate elastic flex member (64, 350) extending between and interconnecting said retaining portions and defining an enclosed expandable chamber therein for selectively receiving a pressurized actuating fluid therein causing said actuating means (42, 344) to expand and react between said frame (12, 312) and said ram (40, 336) and thereby displacing said crushing head (58, 340) from a raised unactuated position forcibly toward said base (14, 314) to a lowered actuated position to crush the filter (F) interposed between said crushing head (58, 340) and said base (14, 314), and including wall mounting means (136) for mounting said apparatus on a wall comprising a bracket (140) secured to said ram rod support portion (92, 358) for attachment to the wall.

21. An apparatus for crushing used oil filters to reclaim residual oil therefrom before disposing of the filters, said apparatus comprising:

a rigid crushing frame (12, 212) having a base (14, 314) for supporting an oil filter (F) on end;

a ram device (40, 336) having a rod (52, 338) slidably supported by said frame (12, 312) for longitudinal movement toward and away from said base (14, 314) and a crushing head (58, 340) secured to a lower end of said rod above said base (14, 314) for engaging and crushing the oil filter (F); said crushing frame (12, 312) including at least one U-shaped tubular member (44; 324, 326) having a pair of left and right upstanding leg portions (46, 48; 328, 330) secured at free ends thereof to said base member (14, 314) and a horizontally disposed top connecting portion (50, 332) spaced above said base (14, 314) and integrally joining opposite ends of said leg portions (46, 48; 328, 330);

self-contained air spring actuating means (42,344) having a rigid upper end retaining portion (62, 352) secured to said frame (12, 312), a rigid lower end retaining portion (62, 354) secured to said ram device (40, 336), and an intermediate elastic flex member (64, 350) extending between and interconnecting said retaining portions and defining an enclosed expandable chamber therein for selectively receiving a pressurized actuating fluid therein causing said actuating means (42, 344) to expand and react between said frame (12, 312) and said ram (40, 336) and thereby displacing said crushing head (58, 340) from a raised unactuated position forcibly toward said base (14, 314) to a lowered actuated position to crush the filter (F) interposed between said crushing head (58, 340) and said base (14, 314), and including wall mounting means (136) for mounting said apparatus on a wall comprising a plurality of apertures (138) provided in at least one of said leg portions (46, 48; 328, 330) of said U-shaped tubular member (44; 324; 326) for receiving fasteners for mounting to the wall.

22. An apparatus for crushing used oil filters to reclaim residual oil therefrom before disposing of the filters, said apparatus comprising:

a rigid crushing frame (12, 212) having a base (14, 314) for supporting an oil filter (F) on end;

a ram device (40, 336) having a rod (52, 338) slidably supported by said frame (12, 312) for longitudinal movement toward and away from said base (14, 314) and a crushing head (58, 340) secured to a lower end of said rod above said base (14, 314) for engaging and crushing the oil filter (F); said base (14, 314) including a pair of mounting members (30, 32; 318, 320) of tubular construction;

self-contained air spring actuating means (42,344) having a rigid upper end retaining portion (62, 352) secured to said frame (12, 312), a rigid lower end retaining portion (62, 354) secured to said ram device (40, 336), and an intermediate elastic flex member (64, 350) extending between and interconnecting said retaining portions and defining an enclosed expandable chamber therein for selectively receiving a pressurized actuating fluid therein causing said actuating means (42, 344) to expand and react between said frame (12, 312) and said ram (40, 336) and thereby displacing said crushing head (58, 340) from a raised unactuated position forcibly toward said base (14, 314) to a lowered actuated position to crush the filter (F) interposed between said crushing head (58, 340) and said base (14, 314), and including floor stand supporting means (148) engaging said mounting members (30, 32; 318, 320) of said base (14, 314) for supporting said apparatus (10, 310) off the floor comprising a floor stand (148) having a pair of support arms (156) extending into said mounting members (30, 32; 318, 320) of said base (14, 314).

23. The apparatus of claim 22 further characterized by said support arms (156) being separable from said mounting members (30, 32; 318, 320) of said base (14, 314).

24. The apparatus of claim 23 further characterized by said support frame comprising a pair of C-shaped leg members (150, 152) having upper horizontal portions thereof forming said support arms (156), a pair of lower horizontal feet portions (154), and a pair of upstanding leg portions (158) interconnecting said upper and lower horizontal portions (156, 154).

25. The apparatus of claim 24 further characterized by said leg members (150, 152) being fabricated of metal tubing material.

26. The apparatus of claim 25 further characterized by each of said leg portions (158) having an upper section (166) and a lower section (168) that are separable from one another.

27. The apparatus of claim 26 further characterized by said lower sections (168) of said leg portions (158) extending into said upper sections (166).

28. The apparatus of claim 26 further characterized by including a cross member (162) extending between and interconnecting said leg portions (158).

29. The apparatus of claim 28 further characterized by including coupling means (170) for coupling said cross member (162) to said leg portions (158) while simultaneously coupling said upper leg sections (166) to said lower leg sections (168).

30. An apparatus for crushing used oil filters to reclaim residual oil therefrom before disposing of the filters, said apparatus comprising:

a rigid crushing frame (12, 212) having a base (14, 314) for supporting an oil filter (F) on end;

a ram device (40, 336) having a rod (52, 338) slidably supported by said frame (12, 312) for longitudinal movement toward and away from said base (14, 314) and a crushing head (58, 340) secured to a lower end of said rod above said base (14, 314) for engaging and crushing the oil filter (F); said base (14, 314) including a pair of mounting members (30, 32; 318, 320) of tubular construction;

and characterized by self-contained air spring actuating means (42,344) having a rigid upper end retaining portion (62, 352) secured to said frame (12, 312), a rigid lower end retaining portion (62, 354) secured to said ram device (40, 336), and an intermediate elastic flex member (64, 350) extending between and interconnecting said retaining portions and defining an enclosed expandable chamber therein for selectively receiving a pressurized actuating fluid therein causing said actuating means (42, 344) to expand and react between said frame (12, 312) and said ram (40, 336) and thereby displacing said crushing head (58, 340) from a raised unactuated position forcibly toward said base (14, 314) to a lowered actuated position to crush the filter (F) interposed between said crushing head (58, 340) and said base (14, 314), and including tabletop mounting means (190) engaging said mounting members (30, 32; 318, 320) for mounting said apparatus on a tabletop comprising a tabletop stand (190) having a pair of support arms (198) extending into said mounting members (30, 32; 318, 320).

31. The apparatus of claim 30 further characterized by said tabletop stand (190) including an L-shaped support member (192) having a horizontal base portion (194) and an upstanding leg portion (196), said support arms (198) projecting outwardly of said leg portion (196).

* * * * *